United States Patent [19]

Guins

[11] 4,222,696

[45] Sep. 16, 1980

[54] ADJUSTABLE FLUID ACTUATED HORIZONTAL BULKHEAD

[76] Inventor: Sergei G. Guins, 4496 Dobie Rd., Okemos, Mich. 48864

[21] Appl. No.: 901,627

[22] Filed: May 1, 1978

Related U.S. Application Data

[63] Continuation-in-part of Ser. No. 585,050, Jun. 9, 1975, Pat. No. 4,089,273.

[51] Int. Cl.[3] ..... B60P 7/14; B61D 3/00; B61D 45/00

[52] U.S. Cl. ..... 410/128; 410/124; 410/135

[58] Field of Search ..... 105/376, 466, 467, 468, 105/486, 487, 488, 489, 490, 492, 493, 494, 495, 496, 491; 280/179 R, 179 A, 179 B; 410/128, 124, 135

[56] References Cited

U.S. PATENT DOCUMENTS

| | | | |
|---|---|---|---|
| 2,529,588 | 11/1950 | Beckett | 105/491 |
| 2,907,580 | 10/1959 | Tietig | 105/468 X |
| 3,673,968 | 7/1972 | Bertram | 105/496 |
| 3,718,099 | 2/1973 | Thornton et al. | 105/492 |
| 3,722,429 | 3/1973 | Holt et al. | 105/376 X |
| 3,791,310 | 2/1974 | Loomis et al. | 105/491 |
| 3,791,311 | 2/1974 | Loomis | 105/491 |
| 3,915,096 | 10/1975 | Salisbury | 105/376 X |
| 4,056,066 | 11/1977 | Homanick | 105/496 X |
| 4,089,273 | 5/1978 | Guins | 105/376 |

*Primary Examiner*—John J. Love
*Assistant Examiner*—Howard Beltran
*Attorney, Agent, or Firm*—Dolgorukov & Dolgorukov

[57] ABSTRACT

The present invention relates to an adjustable bulkhead for preventing the movement of lading within a lading carrying vehicle, such as a railway car, and more particularly, relates to a mechanical bulkhead having a structural frame member adapted to be mounted in a stationary position, with one or more expandable panels connected to said frame member by clevis linkages which are operated by one or more hydraulic cylinders. By the use of an air-operated hydraulic pump fed by a constant volume air reservoir of a size chosen so that as the bulkhead expands the pressure of the air supplied to the hydraulic pump, and thus, the oil pressure in the hydraulic cylinder, will decrease as the natural mechanical advantage of the clevis type linkage comes into play, a substantially uniform force can be kept on the lading regardless of the amount of the expansion of the bulkhead.

The use of the hydraulic cylinder permits a near instant response to the movement of the lading, either in the horizontal or vertical directions with substantially instantaneous expansion of the movable bulkhead panels to take up slack and to prevent the development of voids that were present with the old air bag bulkhead systems, such voids being primarily responsible for cargo damage. The provision of a check valve in the hydraulic line also prevents any backward movement of the panels, and thus, the present invention provides a bulkhead which can initially expand to compress a lading, will maintain a uniform force on the lading, either in a horizontal or vertical direction and will quickly take up any slack which develops in the lading, but which will not retract until the operator desires it to, and thus, substantially eliminates the possibility of any damage to the lading being carried from having voids develop in the lading due to quick starts and stops or bumps of the vehicle, into which cargo can fall and be crushed by further motion of the vehicle.

22 Claims, 25 Drawing Figures

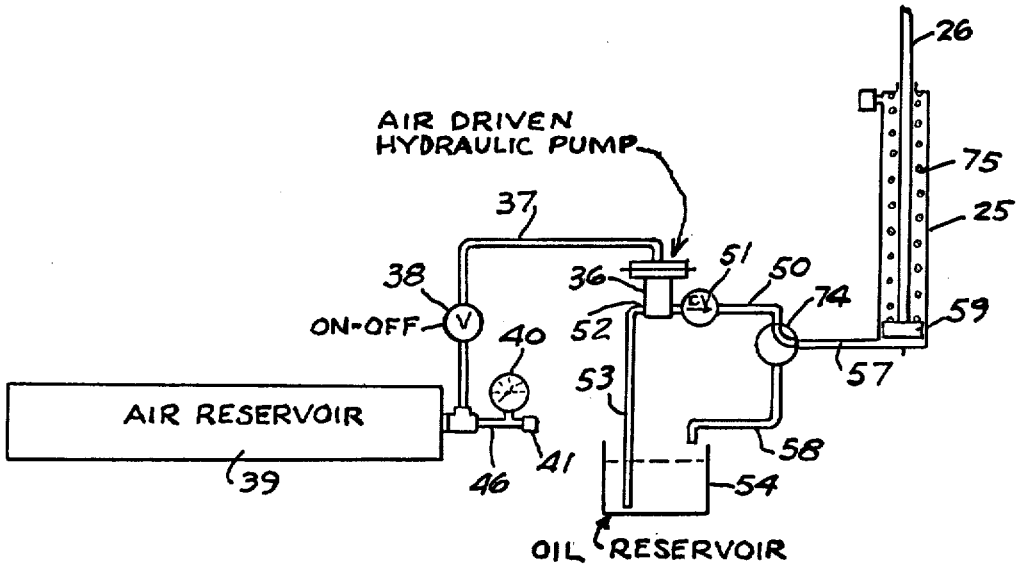
Fig-3
Fig-13
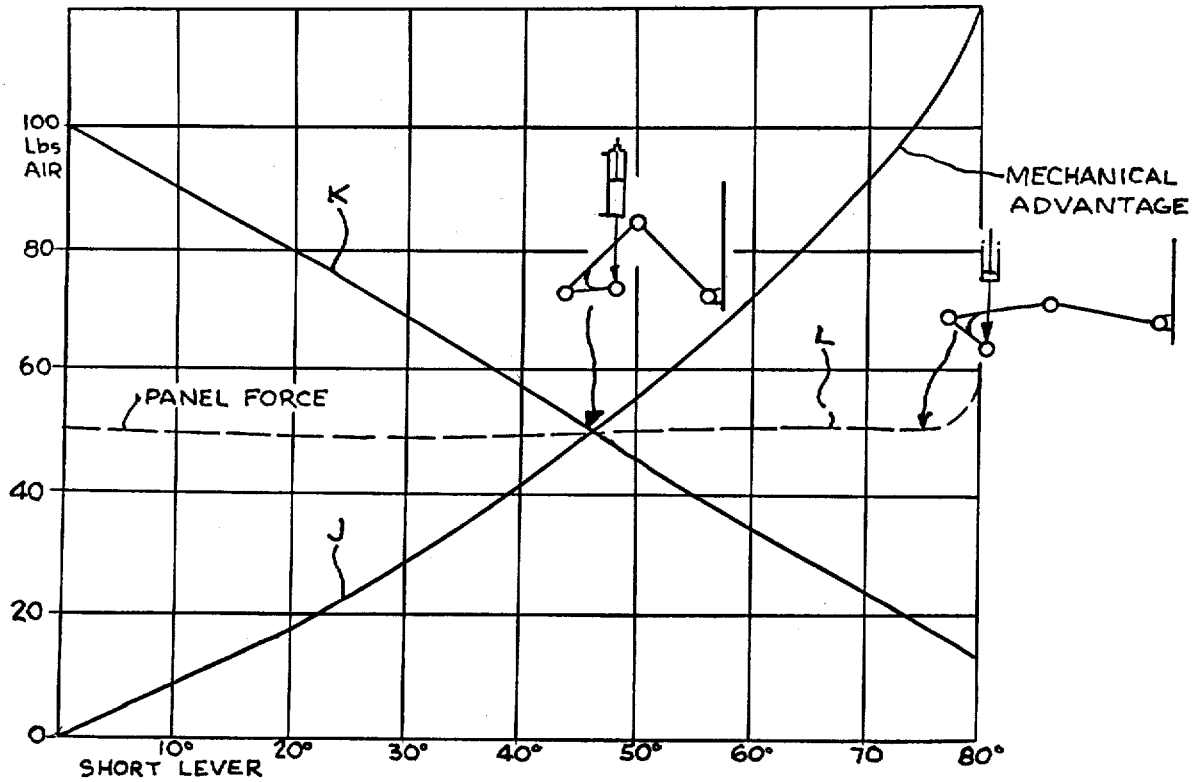

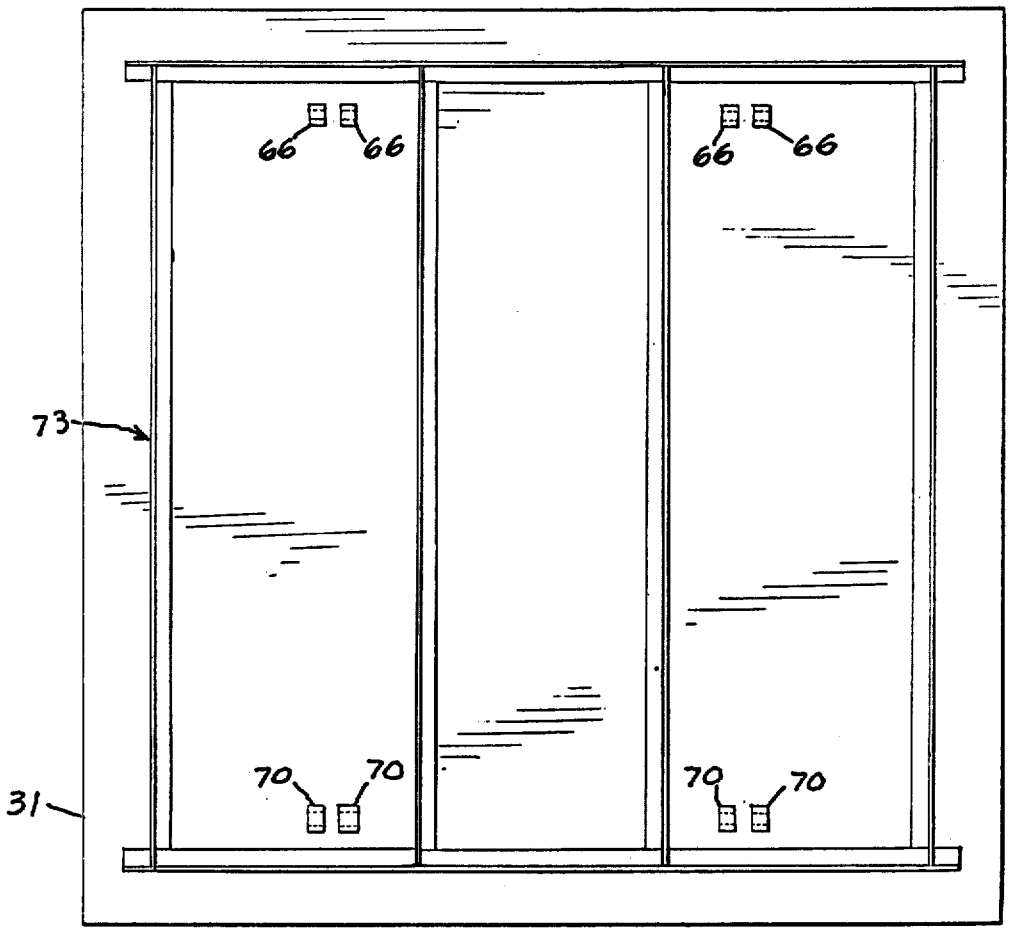
Fig-7
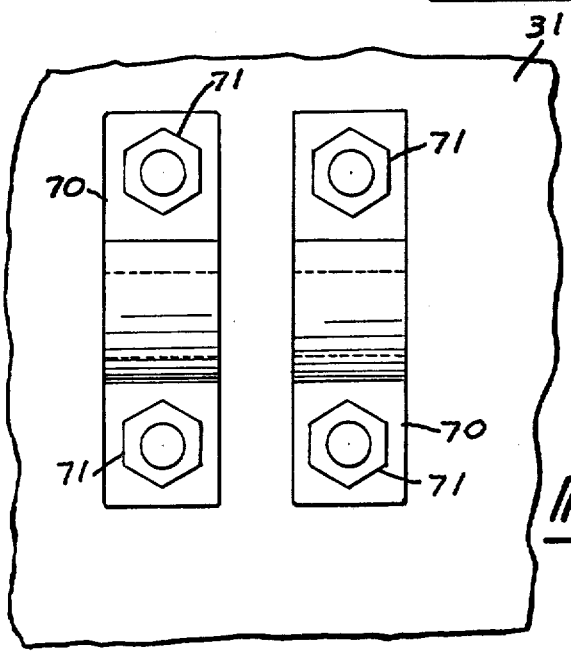
Fig-8
Fig-9
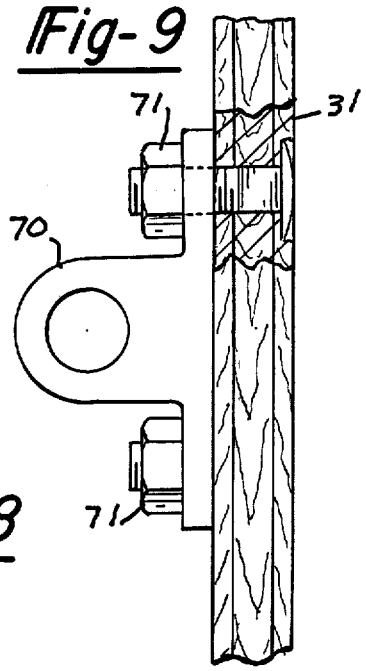

CALCULATION OF $\cos S / \sin R$

| R | SIN R | S | COS S | COS S/SIN R | H |
|---|---|---|---|---|---|
| 80 | .984 | 35 | .819 | .832 | 1248 |
| 75 | .966 | 30 | .866 | .896 | 1344 |
| 70 | .940 | 25 | .906 | .963 | 1444 |
| 65 | .906 | 20 | .940 | 1.037 | 1555 |
| 60 | .866 | 15 | .966 | 1.115 | 1672 |
| 55 | .819 | 10 | .985 | 1.203 | 1804 |
| 50 | .766 | 5 | .996 | 1.261 | 1891 |
| 45 | .707 | 0 | 1.000 | 1.414 | 2121 |
| 40 | .643 | 5 | .996 | 1.549 | 2323 |
| 35 | .574 | 10 | .985 | 1.716 | 2574 |
| 30 | .500 | 15 | .966 | 1.932 | 2898 |
| 25 | .423 | 20 | .940 | 2.222 | 3333 |
| 20 | .342 | 25 | .906 | 2.649 | 3973 |
| 15 | .259 | 30 | .866 | 3.344 | 5010 |
| 10 | .174 | 35 | .819 | 4.707 | 7060 |
| 5 | .087 | 40 | .766 | 8.805 | 13207 |
| 0 | 0 | 45 | .707 | $\infty$ | $\infty$ |

MULTIPLICATION FACTOR DUE TO CHANGE OF ANGLE

Fig-11

| R | S | SIN S | 5 SIN S | STROKE | 2xStroke | X 25.12 | V | Pressure | F 314x8 | Sin R | Cos S | Cos S / Sin R | 1/R Cos S / Sin R | H |
|---|---|---|---|---|---|---|---|---|---|---|---|---|---|---|
| 80 | 40 | .642 | 3.21 | 0 | 0 | 0 | 400 | 100 | 2518 | .985 | .766 | .778 | .432 | 1086 |
| 75 | 35 | .574 | 2.87 | .34 | .68 | 17.08 | 383 | 95 | 2417 | .966 | .819 | .849 | .471 | 1138 |
| 70 | 30 | .500 | 2.50 | .71 | 1.42 | 35.67 | 365 | 91 | 2291 | .940 | .866 | .921 | .571 | 1170 |
| 65 | 25 | .423 | 2.12 | 1.09 | 2.18 | 54.76 | 345 | 86 | 2165 | .906 | .906 | 1.000 | .555 | 1202 |
| 60 | 20 | .342 | 1.71 | 1.50 | 3.00 | 75.36 | 325 | 81 | 2034 | .866 | .940 | 1.085 | .602 | 1227 |
| 55 | 15 | .259 | 1.30 | 1.91 | 3.82 | 95.96 | 304 | 76 | 1914 | .819 | .966 | 1.179 | .654 | 1252 |
| 50 | 10 | .174 | .87 | 2.34 | 4.68 | 117.56 | 283 | 71 | 1788 | .766 | .985 | 1.286 | .714 | 1276 |
| 45 | 5 | .087 | .44 | 2.77 | 5.54 | 139.16 | 261 | 63 | 1637 | .707 | .996 | 1.408 | .781 | 1278 |
| 40 | 0 | 0 | 0 | 3.21 | 6.42 | 161.27 | 239 | 60 | 1510 | .642 | 1.000 | 1.558 | .864 | 1305 |
| 35 | 5 | -.087 | -.44 | 3.65 | 7.30 | 183.38 | 217 | 59 | 1360 | .574 | .996 | 1.735 | .963 | 1310 |
| 30 | 10 | -.174 | -.87 | 4.08 | 8.16 | 204.98 | 195 | 49 | 1234 | .500 | .985 | 1.970 | 1.093 | 1349 |
| 25 | 15 | -.259 | -.259 | 4.51 | 9.02 | 226.58 | 174 | 44 | 1108 | .423 | .966 | 2.28 | 1.265 | 1402 |
| 20 | 20 | -.342 | -.342 | 4.92 | 9.84 | 247.18 | 153 | 38 | 957 | .342 | .940 | 2.75 | 1.53 | 1464 |
| 15 | 25 | -.423 | -.423 | 5.33 | 10.66 | 267.78 | 132 | 33 | 831 | .238 | .906 | 3.51 | 1.94 | 1612 |
| 10 | 30 | -.500 | -.500 | 5.71 | 11.42 | 286.87 | 113 | 28 | 705 | .174 | .866 | 4.98 | 2.76 | 1946 |
| 5 | 35 | -.574 | -.574 | 6.08 | 12.16 | 305.45 | 95 | 24 | 604 | .087 | .819 | 9.41 | 5.22 | 3152 |
| 0 | 40 | -.642 | -.642 | 6.42 | 12.84 | 322.54 | 77 | 19 | 478 | 0 | .766 | ∞ | ∞ | — |

Fig-12

ADJUSTABLE FLUID ACTUATED HORIZONTAL BULKHEAD

The present application is a continuation-in-part application of my previously filed co-pending application entitled "Adjustable Bulkhead" filed on June 9, 1975 under Ser. No. 585,050, now U.S. Pat. No. 4,089,273.

This invention relates to an adjustable bulkhead for preventing the movement of lading within a lading carrying vehicle, and more particularly relates to an adjustable bulkhead of a self-contained variety which needs no constant source of energy, and thus, is adapted for use in moving rail cars and the like, and which is further adapted to provide a substantially uniform load on such lading regardless of how much the adjustable bulkhead may expand due to movement of the lading.

One of the main reasons for damage in transporting cargo is looseness of the loading of the cargo. Upon any impact, such as the coupling of rail cars, the abrupt stopping of semi-trailers, or even from vibration and the like, the load will bunch together on one end of the transportation vehicle, and when the impact is relieved, individual packages may fall into gaps formed between the load and the end wall of the vehicle, and damage occurs. Also, vibration tends to disorient the load, so that when any impact occurs, forces are applied to areas least capable of withstanding them.

This problem is one of long standing in the art, and numerous attempts have been made to solve it, but all have provided only a partial solution to the problem. One of the earliest attempts to solve the problem was to place stationary bulkheads in transportation vehicles, such as railroad cars. A compression device of some sort was used to pack the boxes or other load as tightly together as possible, and then the bulkhead was moved into position and secured. However, when the rail car was under way, due to the numerous stops and starts which the railway train would make, especially in switching operations, no matter how tightly the original load was placed in the railway car, when impact occurred, the load would move forward in a not insignificant degree, leaving a void between the end of the loading and the stationary bulkhead, into which some of the lading would inevitably fall, and upon the rail car once again starting in its normal direction of movement, the load would tend to shift backward, crushing the portion of the load which fell into the void.

Another serious problem which occurs during the numerous stops, starts and switching operations of a railway train or any other moving vehicle is vertical movement and vibration of the lading during transit, and the resulting damage to the contents caused thereby.

Obviously, this was a situation which could not be tolerated for any length of time, and a search for the solution started very early in the life of the railroad industry, and in other related transportation industries, and has been continuing ever since.

Having worked on the railroads for many years and now being an independent transportation consultant, the Applicant is very familiar with attempted solutions to these problems. Among the most recent attempts at these solutions can be seen in the U.S. Pat. No. 3,673,968 to Leroy W. Bertram, and U.S. Pat. No. 3,722,429 to Jan D. Holt. An examination of these patents shows that they both deal with pneumatic bulkhead devices, this being thought, until the present time, to be the best solution to the problem of preventing damage due to movement of the load in the railroad car. However, even the devices shown in these patents suffer from serious problems, and cannot be said to be an adequate solution to the problem.

The first solution attempted to the problem of preventing damage to the lading was simply to place and inflate large air bags in either end of the railroad car after the load had been placed therein. This would compress the load in addition to the forces already applied thereto, and was thought to be a foolproof solution. However, it was not too long thereafter that several problems with the pneumatic air bags were discovered. First, due to size limitations, the pressure which the air bag could exert on the load was relatively limited, and such problem was exaggerated even further due to the fact that it was not desired to over-inflate the air bag, so that the surface of the air bag would more nearly conform to the lading. Although the air pressure in the bag allowed it to expand and take up slack in the lading, as it developed, and did act as a cushion as it compressed under load due to any impact, since the forces developed in the air bag were limited, its re-expansion after being compressed was very slow, and for a period there was always a void at one end of the lading which permitted the lading to fall into the void, or at best, permitted disorientation of the load.

Also, it was found that the air bags were temperature dependent, which caused many problems also. For example, if the railroad car or other vehicle was loaded, and the air bag inflated in a warm climate, and then it was to travel to a relatively colder climate, due to the contraction of the air in the air bag, the pressure in the air bag may be so low as to cause the bag to collapse and become completely ineffective.

On the other hand, the reverse was also found to be true. If the air bag was inflated in a cold climate and traveled into a hot climate, the pressure in the air bag could become dangerously high, and damage to the cargo could result. The same effect on the air bags also can be caused solely by a change in altitude, with the same unfavorable results.

The earlier of the two patents mentioned above apparently was an attempt to solve these problems by interconnecting air bags at each end of the car. As the lading would shift in one direction, and, therefore, compress the air bag at one end of the car, the interconnecting piping would allow air pressure escaping at one end of the car to enter the air bag at the opposite end of the car, and thus, expand it more rapidly than otherwise, and theoretically prevent a void from developing. However, Applicant has found that this construction still permits the development of voids between the lading and the air bags, or panels attached to the air bags, which permits disorientation and damage to the lading, due to the altitude and temperature effects discussed above.

The Holt device addresses itself to a somewhat different problem, the evenness of the loading, and essentially involves the splitting of one large bulkhead into two smaller ones to permit better contact with the lading. Since the bulkheads shown therein will have more intimate contact with the lading, it appears that the chance for the developing of voids would be lessened somewhat, but the bulkheads of the Holt device still suffer from the slow response time and other problems of all air bag devices, and do not adequately protect the lading against damage. Applicant, being familiar with these previous attempts at the solution of the problem, and being in the transportation industry himself, decided that any solely pneumatic system could not provide satisfactory solutions to the long standing problem in the art of how to prevent damage to the lading due to impact, and accordingly, one of the objects of the present invention is to provide an improved, adjustable bulkhead for use in railway cars or similar transportation vehicles.

Another object of the invention is to provide a device of the above nature which is entirely self-contained, and needs no continuing connection to an external source of power.

A further object of the present invention is to provide an adjustable hydraulic-pneumatic bulkhead which will maintain a substantially uniform load on the lading regardless of the amount of expansion undergone by such bulkhead.

Another object of the present invention is to provide a bulkhead system which is unaffected by temperature and altitude changes.

A still further object of the present invention is to provide an adjustable bulkhead which can be initially expanded to compress a lading to a predetermined degree, and will automatically expand further to take up any slack in the lading caused by impact or vibration, and will do so quickly, and thus, prevent any voids from developing.

A still further object of the present invention is to provide an adjustable bulkhead which will maintain a constant pressure on the lading, but which cannot be compressed by the load itself, and thus, eliminates the possibility of any void forming, into which the lading could fall and be damaged.

A further object of the present invention is to provide an adjustable bulkhead of the above nature in which the bulkhead is connected by way of a mechanical linkage to a hydraulic cylinder which, as it expands from oil provided by an air-operated hydraulic pump, moves the bulkhead into intimate contact with the load.

Another object of the present invention is to provide a device as described immediately above, whereby the bulkhead is made such that it cannot be compressed by any impact from the load by virtue of a one-way check valve placed between the hydraulic cylinder and the hydraulic pump.

A further object of the present invention is to provide an adjustable bulkhead of the foregoing nature in which the expansion of the bulkhead is performed by a clevis linkage connecting the hydraulic cylinder to a movable bulkhead panel.

A still further object of the present invention is to provide that the hydraulic fluid supplied to the hydraulic cylinder is supplied by an air-operated hydraulic pump connected to a fixed supply of air of a predetermined volume, chosen so that the volume of air, and thus, the pressure of the air to the pump, and, in turn, the pressure to the cylinder, decreases as the clevis linkage opens (bulkhead expands) and begins to show its mechanical advantage, and thus, the combination of these factors provides a substantially uniform pressure on the lading regardless of the expansion of the bulkhead.

A further object of the present invention is to provide an adjustable bulkhead of the foregoing nature which can be utilized in either the horizontal or the vertical direction depending on the particular application to which it is put.

Further objects and advantages of this invention will be apparent from the following description and appended claims, reference being had to the accompanying drawings forming a part of the specification, wherein like reference characters designate corresponding parts in the several views.

FIG. 3 shows a modification of the system shown in FIG. 2, in which a two-way valve and a spring return are used in place of the four-way valve shown in FIG. 2.

FIG. 7 is an elevational view of the movable panel portion of the adjustable bulkhead of the present invention, showing the structural supporting means thereof, and the means of attaching said metal panel to the mechanical linkage of the present invention.

FIG. 8 is a partial cut-away view showing a portion of the movable panel similar to that shown in FIG. 7, but being made of plywood instead of metal.

FIG. 9 is an end view of the construction shown in FIG. 8.

FIG. 11 is a chart showing the calculation of the force H applied to the load by a simple clevis linkage, as the angle R, which the link attached to the hydraulic cylinder makes with the horizontal, is changed from 80° to 0°, for a constant force of 1,500 pounds, when the length of the linkage attached to the hydraulic cylinder equals the length of the linkage attached to the movable panel of the bulkhead.

FIG. 12 is a chart similar in part to that of FIG. 11, but showing the results obtained by using the construction of the present invention, whereby the use of a fixed volume air reservoir in combination with an air-operated hydraulic pump results in a decreasing pressure being supplied to the hydraulic cylinder which operates the clevis linkage simultaneously with the mechanical advantage of such linkage coming into play, resulting in a substantially constant value for H throughout the major portion of the bulkhead's travel.

FIG. 13 is a graph showing a plot of the mechanical advantage of the clevis linkage used in an embodiment of the present invention, versus the amount of air remaining in the air reservoir which supplies fluid to the hydraulic pump which, in turn, operates the mechanical linkage with the resultant uniform force applied to the lading shown in dotted lines thereon.

Figure 14:
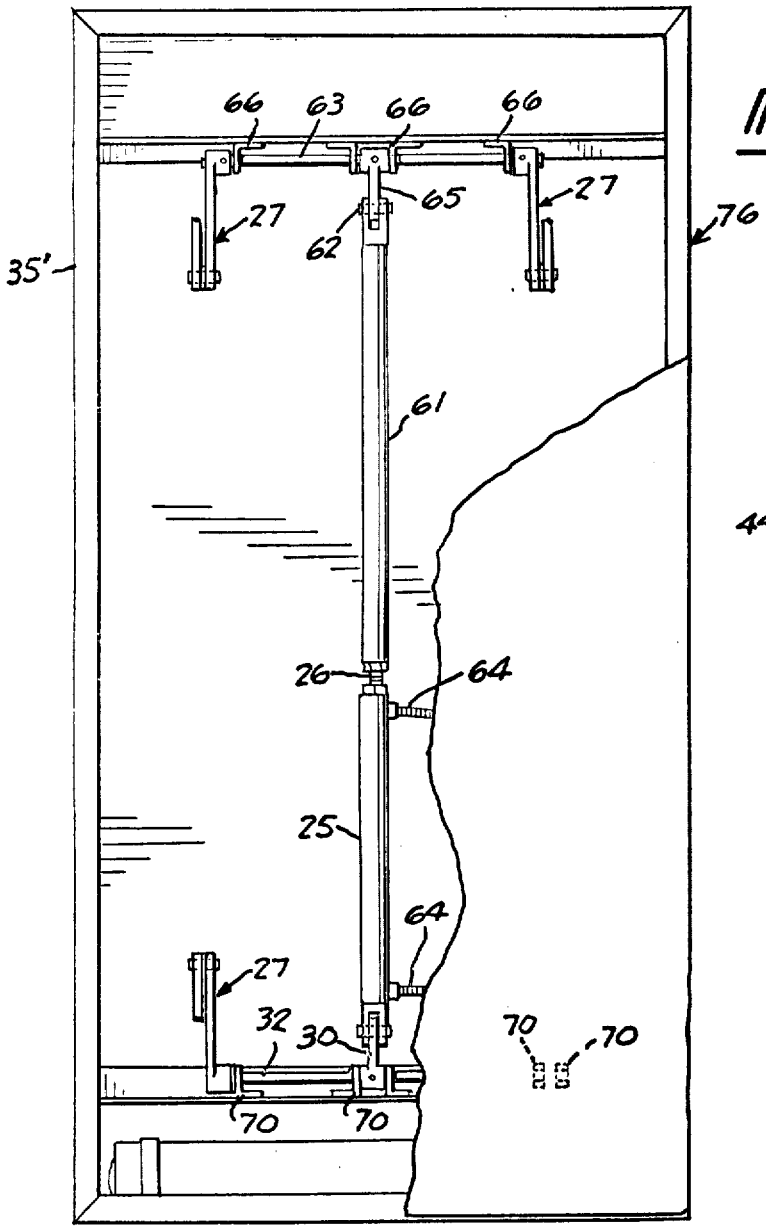

FIG. 14 is a partial cut-away view showing a construction embodying the present invention, but adapted to extend only half way across the vehicle in which it is installed.

Figure 15:
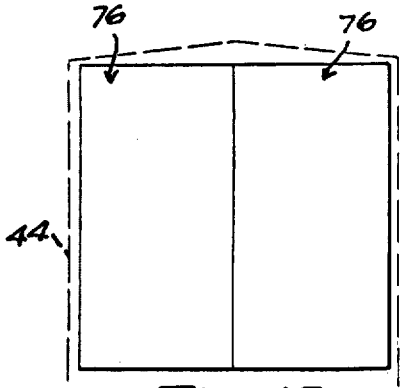

FIG. 15 is an elevational view of a construction embodying the present invention, in which two panels of the type shown in FIG. 14 are mounted in the rail car in a swinging door type arrangement.

Figure 16:
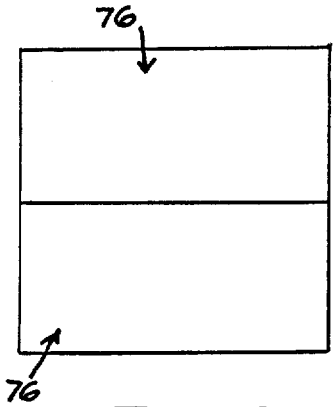

FIG. 16 is an elevational view showing two half-panels as shown in FIG. 14, mounted in a horizontal arrangement.

Figure 17:
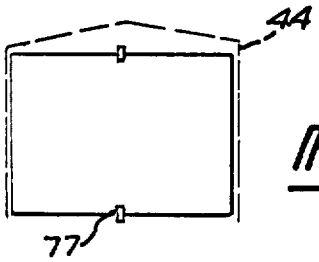

FIG. 17 shows a construction embodying the present invention wherein an entire bulkhead, such as that shown in FIG. 7, is mounted in the vehicle in a manner so that it may pivot about a centrally located position.

Figure 18:
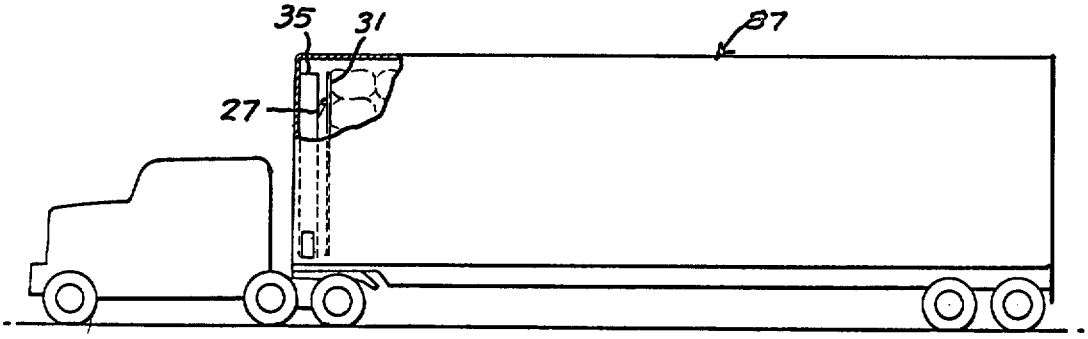

FIG. 18 is a cut-away elevational view showing a single-acting bulkhead embodying the construction of the present invention mounted in the forward end of a semi-trailer.

Figure 19:
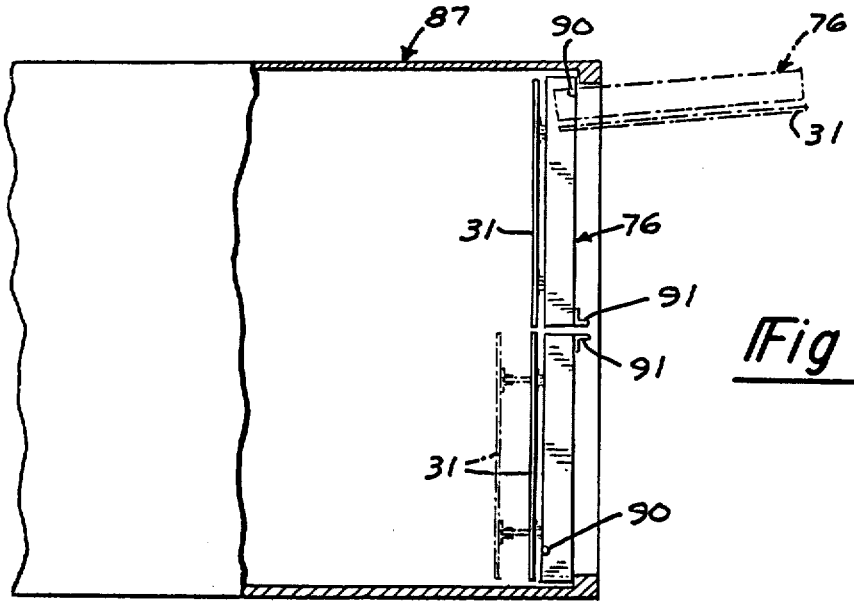

FIG. 19 is a plan view of the end of a cargo carrier showing two bulkheads embodying the construction of the present invention mounted on the rear doors of the cargo carrier.

Figure 20:
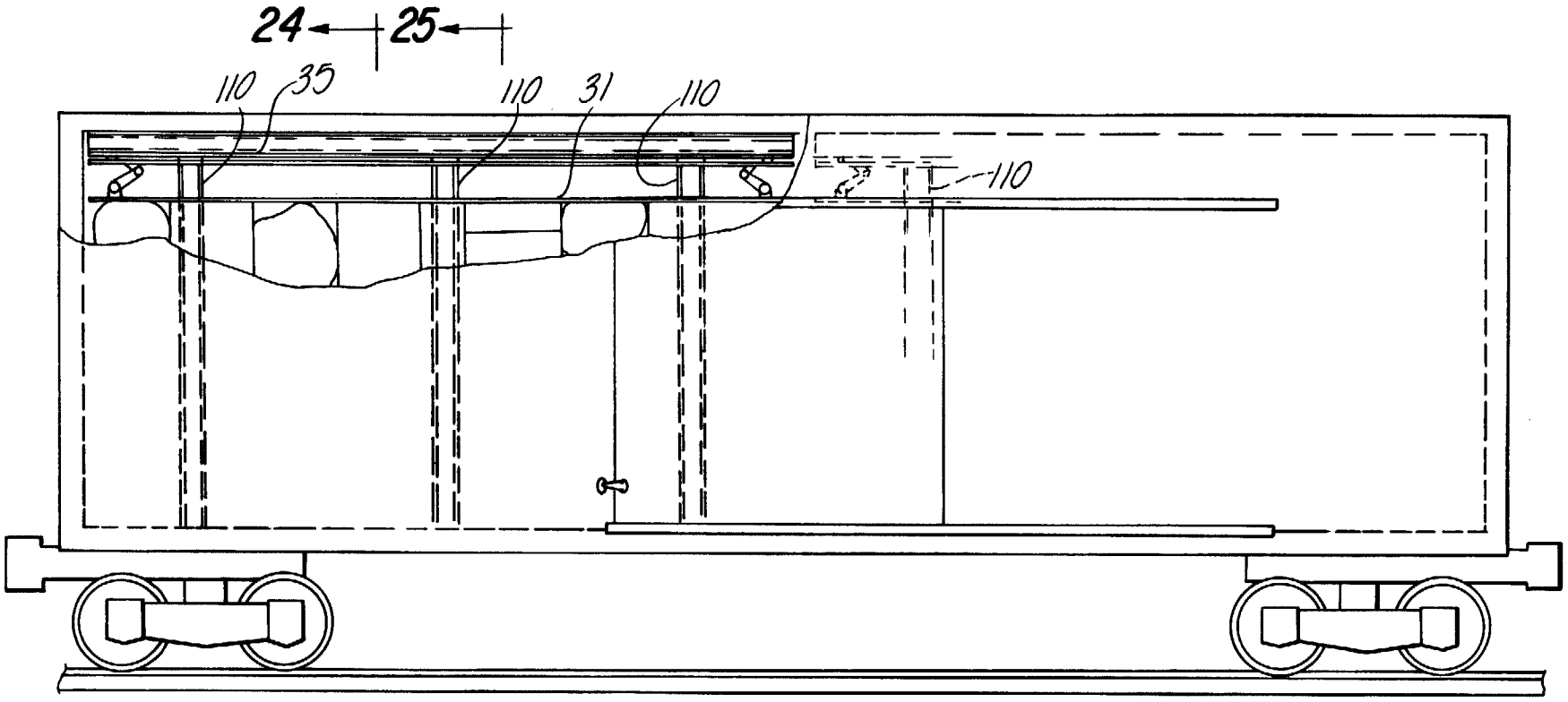

FIG. 20 is an elevational view showing a construction embodying the present invention installed in a typical railway car, wherein the adjustable bulkhead is acting in a vertical direction.

Figure 4:
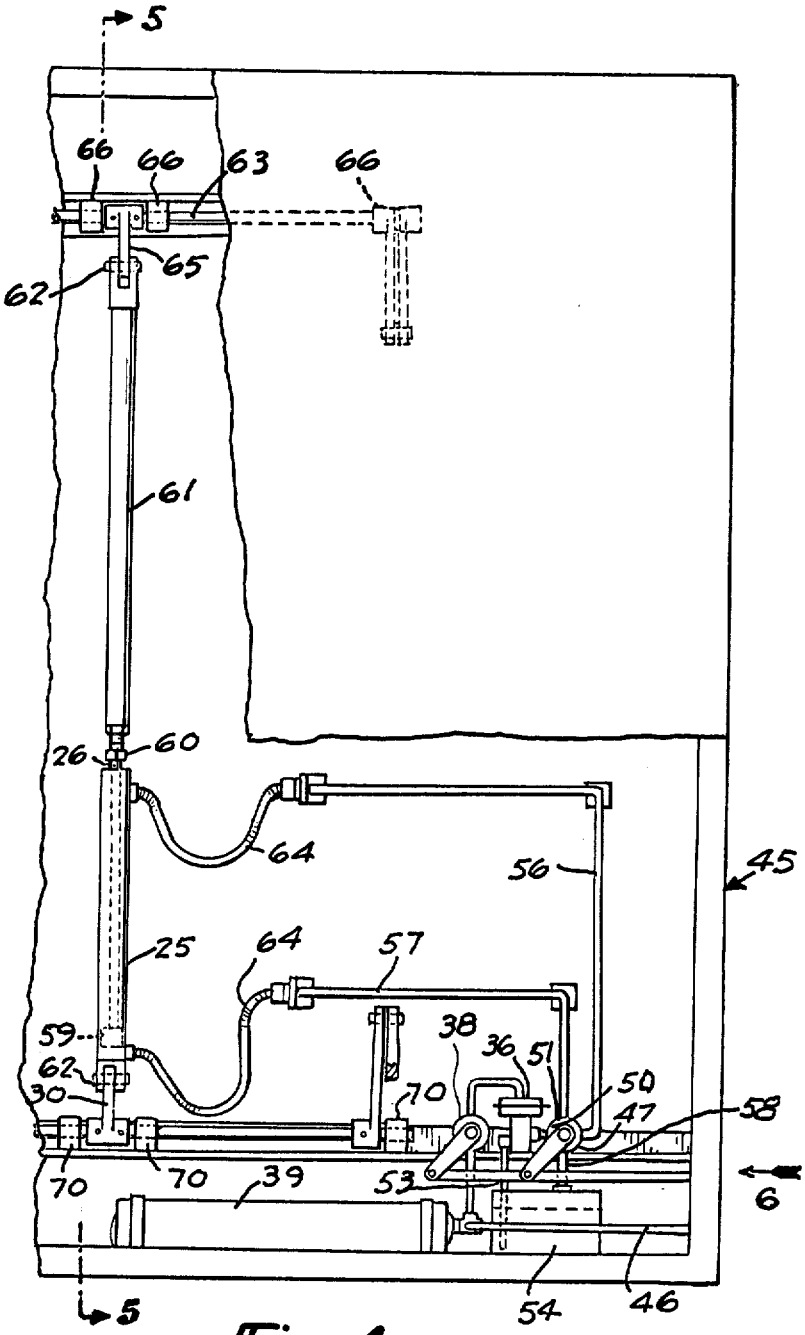
FIG. 4 is a partial cut-away view of one embodiment of the present invention showing the construction of FIG. 2 as it may be actually installed in one end of a railway car.
Figure 21:
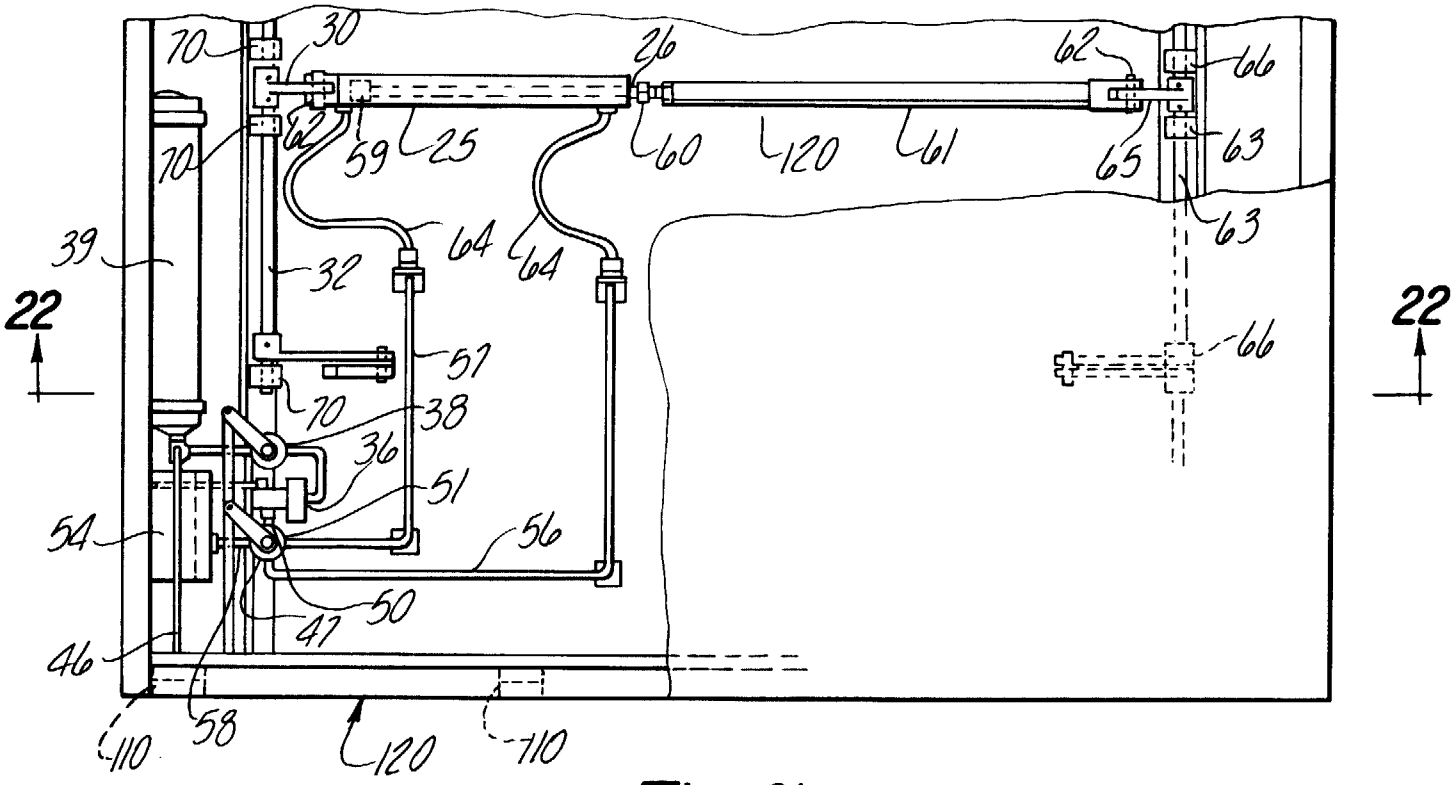

FIG. 21 is a partial cut-away view of the embodiment of the present invention showing the construction of FIG. 4, as it may be actually installed at the top of a railway car.

Figure 22:
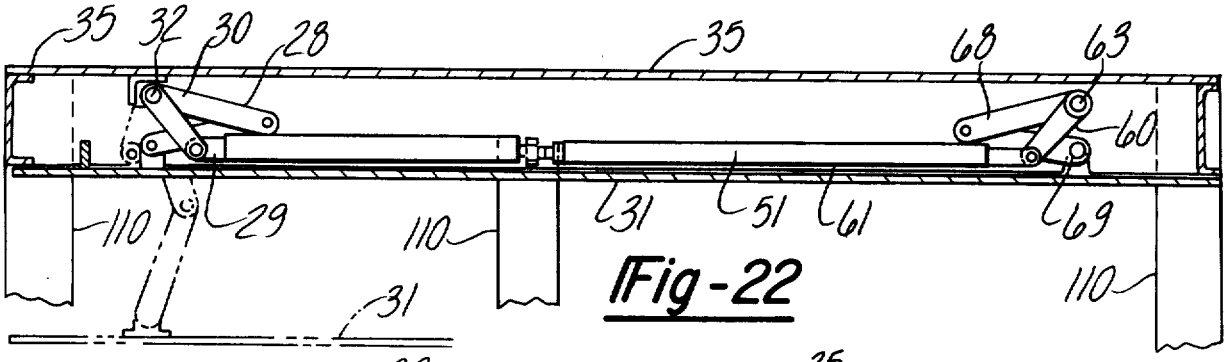

FIG. 22 is a sectional view taken in the direction of the arrows on the section line 22—22 of FIG. 21.

Figure 23:
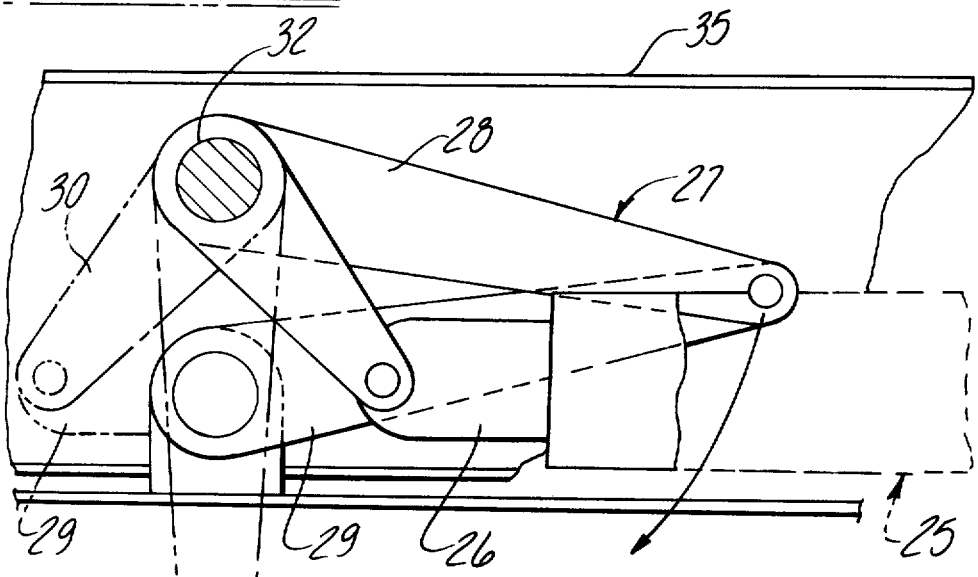
Figure 23:
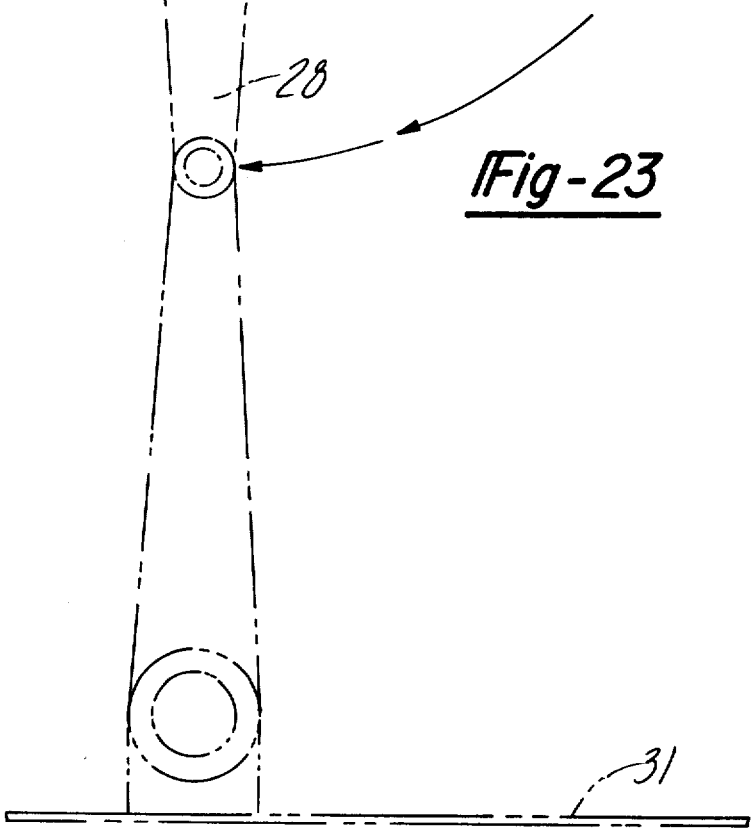

FIG. 23 is a partial elevational view similar in part to FIG. 22, but showing the mechanical linkage on a much larger scale.

Figure 24:
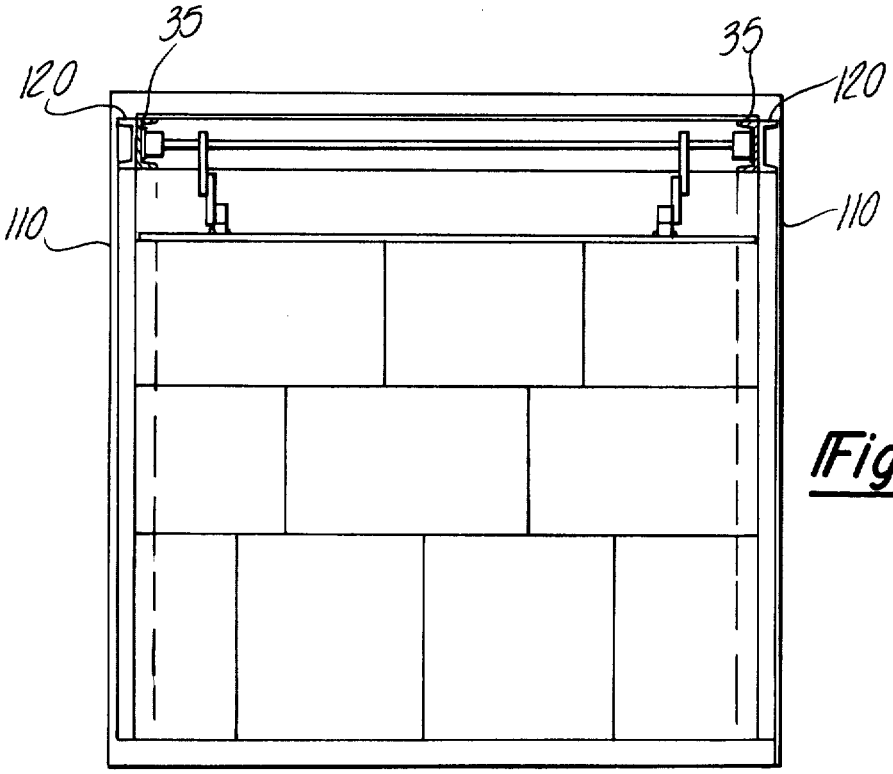

FIG. 24 is a sectional view taken in the direction of the arrows on section line 24—24 of FIG. 20 showing the adjustable bulkhead acting in a vertical direction on a uniform lading.

Figure 25:
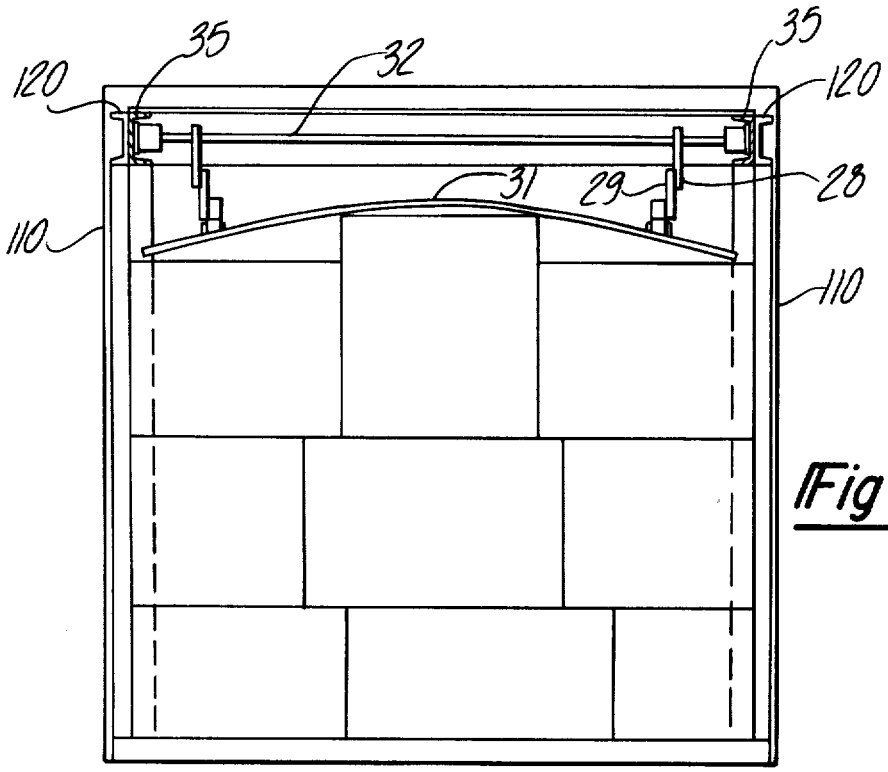

FIG. 25 is a sectional view taken in the direction of the arrows on the section line 25—25 of FIG. 20 and being similar in part to FIG. 24, but showing how the adjustable bulkhead acting in a vertical direction may appear, if an irregular lading is present.

It is to be understood that the invention is not limited in its application to the details of construction and arrangement of parts illustrated in the accompanying drawings, since the invention is capable of other embodiments, and of being practiced or carried out in various ways within the scope of the claims. Also, it is to be understood that the phraseology and terminology employed herein is for the purpose of description, and not of limitation.

Applicant, upon deciding that the pneumatic air bags could not offer a satisfactory solution to the problems of damage caused by movement of a lading upon impact in rail cars and the like, first attempted to simply connect a hydraulic cylinder to an appropriate mechanical linkage which, in turn, would expand a movable bulkhead panel. After much experimentation, the Applicant arrived at the use of a hydraulic cylinder such as that shown by numeral 25 in FIG. 10, with the piston rod 26, of the hydraulic cylinder 25, operating what is commonly known as a clevis linkage, generally designated by the numeral 27, and consisting of a first link 28 and a second link 29. This linkage was connected by the short link 30 to the piston rod 26 on one end and to the movable bulkhead panel, generally designated by the numeral 31, on the other end, all of these devices being rotatably attached to the shaft 32 which is supported by a structural member, generally designated by the numeral 35.

Figure 10:
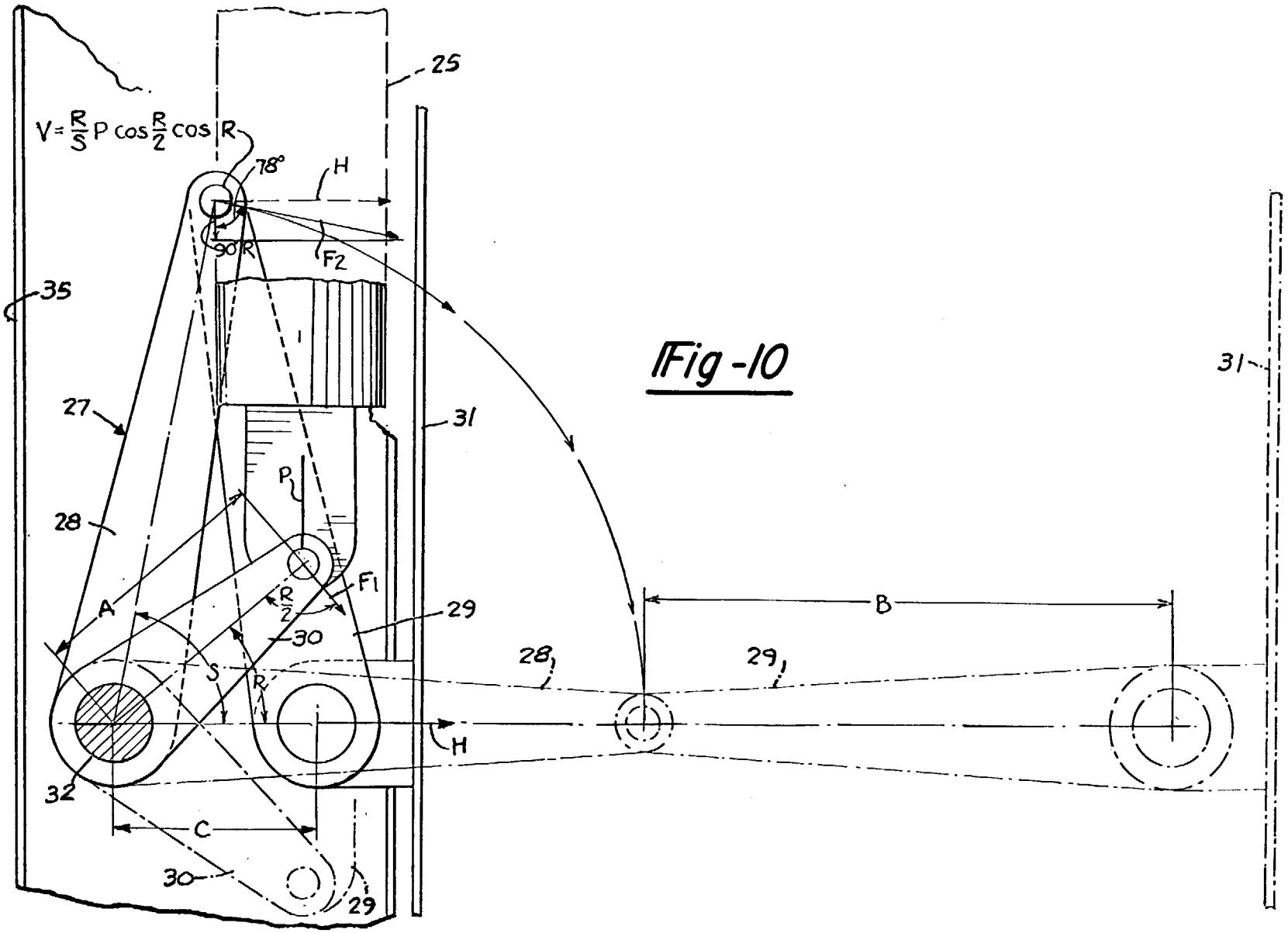
FIG. 10 is a partial elevational view similar in part to FIG. 5, but showing the mechanical linkage on a much larger scale.

However, Applicant's first solution to the problem as just described met with total failure. As shown in FIGS. 10 and 23, the total angular movement of the link 30 must be equal to the angular movement of the link 28. If this movement were to equal 80°, and a hydraulic cylinder were to directly operate the clevis linkage 27, as shown in FIG. 11, as the short link 30 was pivoted about the shaft 32 by the piston rod 26 through an angle of 80°, beginning at 40° above the horizontal and ending at 40° below it, the force H on the load would vary from a value of approximately 1,200 pounds to infinity. Obviously, it can be seen that if the bulkhead had to expand by more than a minor amount to compensate for the shift in the lading, there would be a point reached where the force on the load would be greater than the loading could withstand, and at that point the load would begin to crush and the movement of the bulkhead, due to the mechanical advantage of the clevis type linkage, would accelerate at an ever increasing rate and would completely crush the load in the rail car.

A similar result would obviously occur with the embodiment of the present invention as disclosed by FIG. 23, where the adjustable bulkhead is acting in a vertical direction.

While Applicant was convinced that a hydraulic cylinder-mechanical linkage arrangement was still the solution to this long standing problem in the art, Applicant had to find a way to keep the force H relatively constant, or at least from increasing at such an accelerating rate. Since Applicant desired to retain the simplicity of the clevis linkage, he next sought to vary the pressure applied to the linkage, and more particularly thought, that if the pressure to the hydraulic cylinder could be made to decrease as the clevis linkage was expanding, the combination of these effects would produce a substantially constant force being supplied to the movable panel 31, in FIGS. 10 and 23.

The simple motor driven hydraulic pump could not be used because there was no practical source of continuous electric power in the box car, and it would be prohibitively expensive to place a self-contained generating unit into each box car, and further some type of response system which would sense the forces applied to the lading and relay this back to the hydraulic pump would have to be designed. Thus, Applicant turned to the construction that finally proved feasible, that of an air-driven hydraulic pump, as shown by the numeral 36 in FIG. 2.

By connecting the pump 36, by means of a conduit 37, and an on-off valve 38, to an air reservoir 39, provided with a pressure gauge 40, and an air-fill valve 41, Applicant has provided a simple, rugged, and relatively inexpensive source of hydraulic power which is completely self-contained, and can easily be mounted in a typical railroad car. Further, Applicant has provided the perfect solution to the problem of how to vary the pressure supplied by the hydraulic pump. As can be determined from FIG. 13, from an examination of the curve labeled J, as the hydraulic cylinder 25 shown in FIG. 10 expands, thereby causing the piston rod 26 to pivotally rotate the link 30 on the shaft 32 which, in turn, causes the first link 28 to rotate about the shaft 32, and causes the link 29 to expand the movable panel 31, as the link 30 rotates through 80°, the force exerted by the panel 31, if not otherwise controlled would go to infinity, which is the typical mechanical advantage of the clevis linkage.

However, by providing a fixed volume of air in the air reservoir 39, as the hydraulic pump 36 begins supplying pressure to the hydraulic cylinder 25, the volume of air in the reservoir and thus, the pressure of the air supplied through the conduit 37 to the pump 36, begins to decrease as illustrated by the curve labeled K in FIG. 13. This example shows K decreasing from 100 pounds per square inch to 19 pounds per square inch, as the lever 30 is rotated through 80°.

The resultant of these two effects is shown by the curve labeled L, which represents the force exerted by the movable panel 31. As can be seen for this example, the panel force remains almost constant through approximately 75° of movement of the lever 30, and then increases rapidly as the movement approaches 80°. By varying the volume of air in the reservoir 39, the length of the various linkages 28, 29 and 30, and the capacity of the pump 36, the characteristics of curve L can be modified. While it is desirable to maintain the constant panel force as shown until the linkage is almost completely extended, the change occurring near the end of the movement of the linkage may be important in certain circumstances. Instead of increasing rapidly as shown in FIG. 13, this may be constant until the full movement of the linkage.

Figure 5:
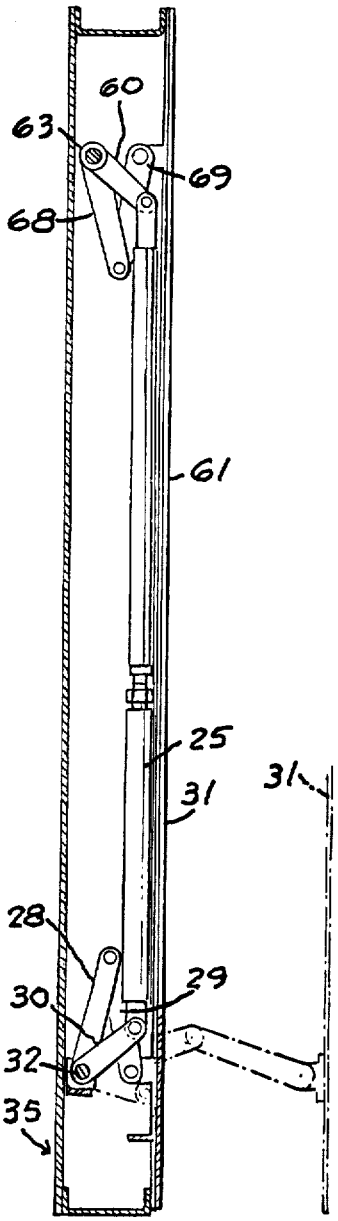
FIG. 5 is a sectional view taken in the direction of the arrows on the section line 5—5 of FIG. 4.

Referring now specifically to FIGS. 1–6, the railroad cars generally designated by the numeral 44 would be fully loaded while the adjustable bulkhead of the present invention was in its fully retracted position, as shown by the solid lines in FIG. 5. After the loading is completed, the doors 45 of the car 44 are closed, and air is introduced into the air reservoir 39 by way of the conduit 46, fill valve 41 and valve control means 42, until a predetermined pressure is registered on the air gauge 40, at which time the filling operation is completed. It should be understood that the filling of the reservoir can take place before the loading of the rail car. After the loading of the rail car, the on-off valve 38 is turned on to allow the air from the air reservoir 39 to proceed to the hydraulic pump 36. The four-way valve 47 is connected to the pump 36 by the conduit 50, in which there is placed a one-way check valve 51. The check valve 51 is placed at the pump outlet with the pump inlet 52 being connected by way of another conduit 53 to an oil reservoir 54.

The other ports of the four-way valve are connected to the upper end of the hydraulic cylinder 25 by means of the hydraulic line 56, and flexible connector 64. By way of another flexible connector 64, the hydraulic line 57 is connected to the lower end of the cylinder, with a return line 58 communicating with the reservoir 54. When the four-way valve is turned to the appropriate position to expand the movable panel 31, oil from the reservoir 54 enters the pump 36, passes through the check valve 51, the conduit 50, the four-way valve 47, and the lower hydraulic line 57, and enters the hydraulic cylinder 25, pushing the piston 59, and thus, the piston rod 26 upwardly. The end of the piston rod 26 opposite the piston 59 is attached by fastening means 60 at one end to the connecting bar 61 which is, in turn, rotatably connected to the upper link 65 by the pin 62. The link 65 is fixedly mounted to the upper shaft 63 which is adapted to rotate by virtue of its being rotatably mounted in the upper shaft supports 66.

At the opposite end of the hydraulic cylinder 25, the cylinder itself is rotatably mounted to the lower link 30 by means of another pin 62, with the lower link 30 being fixedly mounted to the lower shaft 32 which is also adapted to rotate by virtue of being rotatably supported by the lower shaft supports 70. The lower clevis linkage 27 and the upper clevis linkage 27 are attached to the movable panel 31. With the ends of links 29 and 69 being rotatably affixed to the movable panel 31 by multiple pivot supports 66, 70 attached by suitable nut and bolt arrangements, to the panel 31 cooperating with suitable mounting pins (not shown).

It is preferred that all the clevis linkages 27 be mounted in a relation to each other such that the resulting force component produced by the linkages is acting only in the direction of the required movement of the panels 31.

It should be understood that the number of clevis linkages to be used will depend on the cargo which it is contemplated will be carried, and whether the cargo will be carried in a railroad box car, semi-trailer or other like vehicle. While there is described in regard to FIGS. 4 and 22 an apparatus with two clevis linkages, there is also shown in FIGS. 4 and 21 a provision for two additional clevis linkages making a total of four. Applicant prefers for normal installation in the box car to have four clevis linkages attached to a movable panel 31, made out of plywood, such as shown in FIGS. 8 and 9. This provides Applicant with the opportunity to use a movable panel which is still somewhat flexible, but is adequately supported. However, where the cargo is in the form of rigid containers or the like, it is quite possible that two clevis linkages would be sufficient if the panel were made of metal as shown in FIG. 7, and supported by suitable framing, generally indicated by the numeral 73.

In general, referring to FIGS. 4 and 21, Applicant prefers to use opposing upper and lower shafts, such as 63 and 32, with two of the clevis linkages being symmetrically spaced and rotated by each shaft, with both shafts being rotated by the cylinder 25. However, it can be seen that, depending on the particular application, more hydraulic cylinders than the one shown may be necessary, or that more linkages and corresponding attachments to the metal panels may be needed, or that more shafts may be needed which would be operated by one, or a number of hydraulic cylinders.

In line with the requirements for full disclosure, Applicant wishes to present several illustrative examples showing the considerations which must be taken into account in designing the adjustable bulkhead embodying the invention.

The first consideration must involve the type of vehicle which the present invention will be mounted in. For the present examples Applicant has chosen the typical railway box car.

The next consideration that must be taken into account is the range of adjustment of the bulkhead, and by referring to the linkage shown in FIGS. 10 and 23, it can be seen that this value will be equal to 2B-C.

Next, the width of the structural frame member of the bulkhead 35 must be decided upon, as this determines the maximum value of the dimension C. The value of C should be as large as practicable and controls the angle R, with R equaling arc cos C/2B.

In the expansion of the bulkhead, the link 30 of dimension A will rotate through the angle R. Link 28 will be of the same dimension as link 29, and which, because it is attached to the same shaft as the link 30, will also rotate through the angle R. For maximum mechanical advantage, the lever 30 is arranged at an angle $R=S/2$ relative to the horizontal.

It can be seen then that the component $F_1$ of the force P produced by the hydraulic cylinder is equal to PcosS. This component $F_1$ produces a torque $F_1A=PAcosS$ on the shaft 32, and on the links 30 and 28. From this it can be seen that the force at point 2, $F_2=P(A/B)cosS$. The force $H=F_2sinR$. Then H, the force on the panel 31, equals: $H=F_2\cdot 1/sinR=P\cdot(A/B)cosS\cdot 1/sinR$.

Thus, the force H is the available force that will act to expand the movable panel 31 against the lading, and H/P is the force relationship between the applied force P produced by the hydraulic cylinder 25, and the available force H, with $H/P=(A/B)cosS\cdot 1/sinR$. It can be seen that for any given force applied to the link 30, a resultant force applied to the movable panel 31 can be obtained. The discussion then, thus far, relates to Applicant's first attempt to solve this problem, and if one again refers to the table of FIG. 11, it can be seen that assuming a force of 1,500 pounds is applied to the link 30, with the link 30 equaling in length the link 28, as the angle R approaches O, the factor cos S/sin R approaches infinity, and the available force H applied to the movable panel 31 also approaches infinity. Thus, it is obvious that, if constant pressure were to be applied to the lever 30 by the hydraulic cylinder 25, the force H at some point would be too great, and could damage the lading.

The importance can now be seen of selecting an appropriate volume air reservoir 39, because the condition just explained can also be approximated if the reservoir is selected too large in relation to the expansion of the movable panel. A volume must be selected so that the pressure drop in the air reservoir 39 will compensate for the multiplication of the forces in the clevis linkage. Again, it should be understood that the particular volume of the reservoir to be selected depends on the particular job to be done, and the particular relationship which is desired, as explained in connection with FIG. 13. Applicant has found that if the volume of the reservoir is chosen in relationship to the hydraulic pump which is used, a rather predictable relationship results.

Applicant has found that a pump with a multiplication ratio of 1 to 8 is satisfactory for most purposes. An air-operated hydraulic pump with a multiplication ratio of 1 to 8 has an air piston area eight times as large as that of the oil piston, with the result that for each cubic inch of oil pumped to the cylinder 25, eight cubic inches of air is drawn from reservoir 39. The pressure in the air reservoir is reduced as the air is used up, and would follow the law $PV=wrt$, as the volume of the reservoir is constant. the relation $P_1V_1/P_2V_2=w_1rt_1/w_2rt_2$ would show that the pressure $P_2=P_1\cdot w_2/w_1$, or that the drop in pressure will be proportional to the weight of the air used, if the temperature is kept constant. An approximation for the above relationship can be obtained by the formula:

$$P_2=P_1[(P_1V_1-P_1V_o)/P_1V_1]=P_1[(V_1-V_o)/V_1].$$

For each movement through the angle S, link 30 will move through the distance equal to $A(\sin S_o-\sin S)$. Since the hydraulic cylinder 25 moves two of these levers in the opposite direction, the stroke is $2A(\sin S_o-\sin S)$. If $S_o$ is the initial angle, in this case, 40°. Therefore, if the area of the hydraulic cylinder is 3.14 square inches, the oil volume change in regard to the stroke of the cylinder will be $2A(\sin S_o-\sin S)\cdot 3.14$ cubic inches, and the air volume will be $2A(\sin S_o-\sin S)3.14\cdot 8$.

Thus, the new pressure in the air reservoir at any given point will be equal to $(P_o/V_o)[V_o-2A(\sin S_o-\sin S)3.14\cdot 8]$, or $F=(P_oV)[V_o-2A(\sin S_o-\sin S)3.14\cdot 8)]\cdot 3.14\cdot 8$, and the force H for any angle will equal $[(P_o/V_o)[V_o-2A(\sin S_o-\sin S)3.14\cdot 8]\cdot 3.14\cdot 8(A/B)\cos S/\sin R$, where $V_o$ is the initial volume, and $P_o$ is the initial pressure in the air reservoir 39.

Using these relationships and letting the angle $R=80°$ and the angle $S_o=40°$, the link 28 being five inches long, and the link 30 being nine inches long, the various values can be calculated for this particular example, and are shown in FIG. 12. The values shown in FIG. 12 assume air reservoir volume is 400 cubic inches, at an initial pressure of 100 pounds per square inch. As can be seen, the pressure on the movable panel 31 is kept substantially constant until the last five or ten degrees of movement. Thus, it can be seen that Applicant has achieved his purpose of providing a reliable, rugged, simple and relatively inexpensive adjustable bulkhead for a wide variety of transportation by providing a fixed air source supplying an air-operated hydraulic pump, which, in turn, supplies hydraulic fluid to the hydraulic cylinder 25, and moves the panel 31 by means of the clevis linkages 27 in a manner whereby the diminishing pressure in the air reservoir offsets the mechanical advantage of the linkage 27, and provides a constant force on the bulkhead 31.

Figure 1:
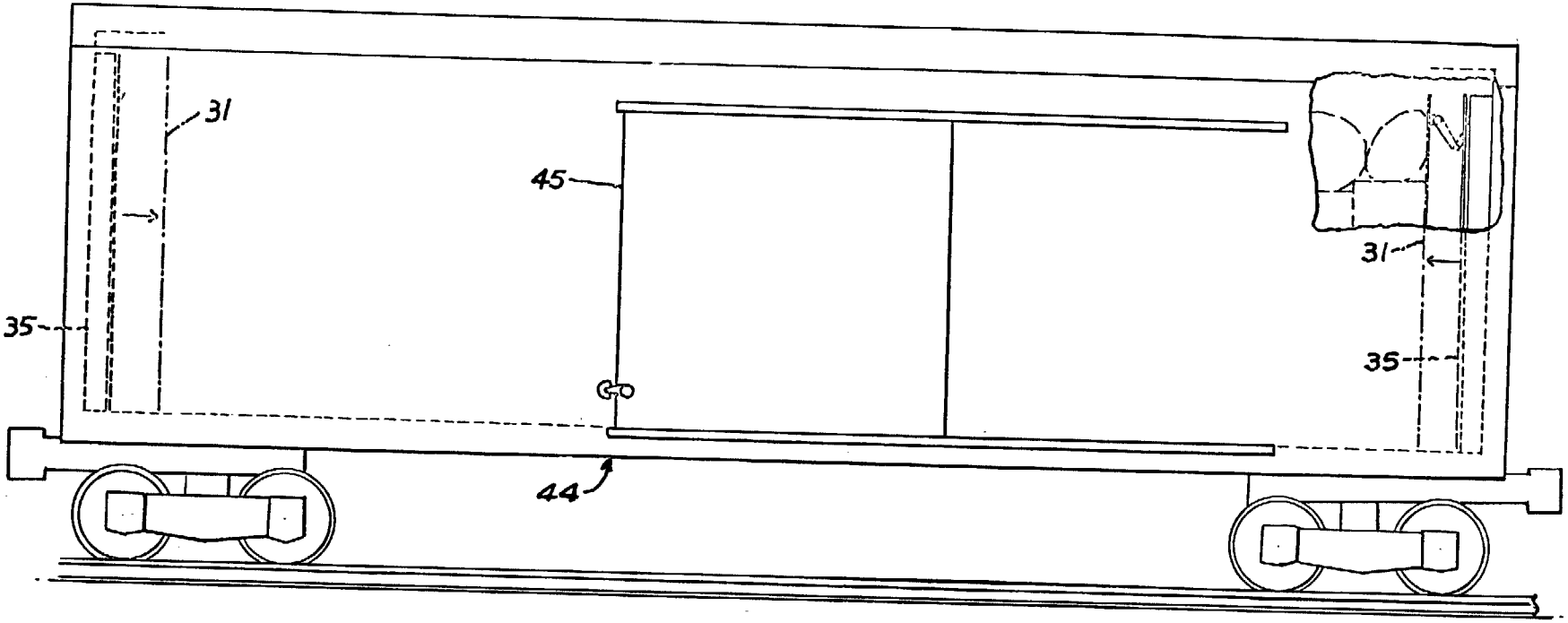
FIG. 1 is an elevational view showing a construction of a device embodying the present invention installed in a typical railway car wherein the adjustable hydraulic-pneumatic bulkhead is acting in a horizontal direction.
Figure 2:
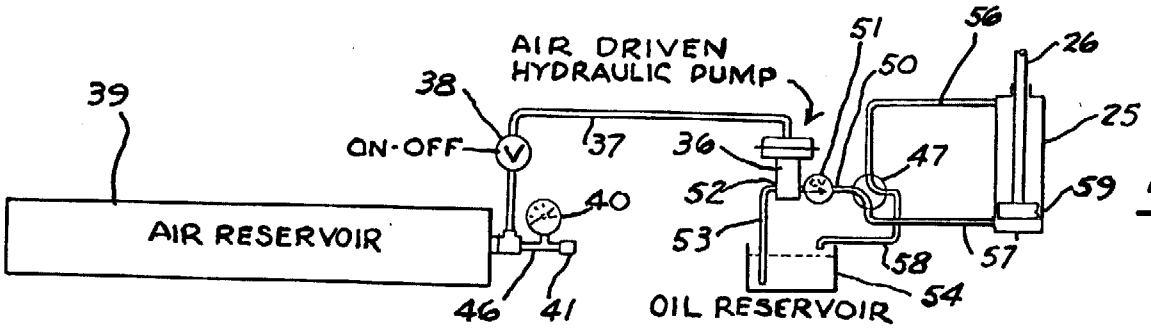
FIG. 2 is a diagrammatic view of the portion of the system of my invention which is used for operating the hydraulic cylinder attached to the mechanical linkage, which, in turn, is attached to the movable bulkhead used in one embodiment of the invention.

To complete his invention, the Applicant provided for the situation whereby there may be some back pressure on the panel 31 whether in a vertical or horizontal direction due to impact of the lading. Applicant has provided a one-way check valve 51 in the hydraulic system as best shown in FIGS. 2, 4 and 21. If the check valve was not provided, back pressures on the panel 31 would cause the piston 59 of the hydraulic cylinder 25 to be forced downward, resulting in hydraulic fluid being forced back through the pump 36, into the reservoir 54, and resulting in a possible void developing between the panel and the lading. With the provision of the check valve 51, when the panel 31 is being moved up against the lading, when it reaches its final position, the pump 36 will stall, and thus, keep the constant pressure on the load. If any back pressure is encountered, the check valve 51 would come into operation, and would not permit fluid to move back through the pump 36, thus eliminating any possibility of voids developing. Thus, in addition to solving the problem of excessive pressure being applied to the lading if only the hydraulic linkage was used, Applicant has also solved the problem of how to prevent voids from developing when the linkage is used.

In addition to solving these long standing problems in the art, Applicant's invention is modifiable in a wide variety of ways to meet almost any conceivable situation. If swift retraction of the movable panel 31 is not required, Applicant's system can take the form shown in FIG. 3, whereby a two-way valve 74 is provided in place of the four-way valve 47, and a spring retraction means 75 will perform the retracting function when the valve 74 is turned to the appropriate position. As can be seen from an examination of FIG. 3, the spring retraction means can be either internal or external in nature. The remaining parts of the system are the same as described in connection with FIG. 2, and it is not believed necessary to redescribe them.

Also, by virtue of the method of connection of the linkages 27, to the movable panel 31, the panel is free to tilt in a vertical plane to compensate for irregularities in the loading.

Also, Applicant's adjustable bulkhead can be made in a wide variety of shapes and sizes to meet almost any situation. As shown in FIG. 15, Applicant's bulkhead may be made in the size of substantially half the railroad car or other transportation vehicle, and the two half-panels may be adapted to be hinged at their sides as shown in FIG. 15, so they may swing open from the middle. This arrangement can be used in the situation, among others, where it is preferable to have the adjustable bulkheads near the middle of the rail car, so that the panels can be swung open, the load can be placed in position, and the panels closed and secured, within the bulkhead then being expanded in the manner previously described.

Additionally, the half-panels may be suspended in a horizontal arrangement, as shown in FIG. 16, in the situation for example, where the rail car or other transportation vehicle may be loaded from one end. The two panels may be opened, with the lower panel possibly being used as a loading ramp and being suitably reinforced, with the load then being placed in the vehicle, and the panels being closed and expanded as described. Such an arrangement may also be very beneficial when the railway car is loaded in a two-tier arrangement, with different cargo on each level. Whether the arrangement of FIG. 15 or 16 is used, the bulkhead, the various components thereof may be arranged as shown in FIG. 14, whereby the half-panel generally designated by the numeral 76, consists of the structural frame member 35, with the upper shaft 63 and the lower shaft 32 being rotatably supported thereon by the various supports 66, 70. Fixedly connected to the upper shaft 63 are the two clevis linkages 27, as well as the link 65. Connected to the lower shaft 32 are the two clevis linkages 27 and the lower link 30. The connecting bar 61 is rotatably connected to the link 65 by the pin 62, as previously described, with the other end of the hydraulic cylinder being connected to the lower link 30, also as previously described, with the flexible connectors 64 connecting the hydraulic cylinder 25 to a system which would be similar to either that described in FIG. 2 or FIG. 3. Also, if desired, the entire bulkhead may be pivoted about a vertical axis passing through the center line of the railroad car 44 on suitable pivoting means 77, as shown in FIG. 17.

Finally, the entire bulkhead may be placed in a horizontal position at or near the top of the transportation vehicle as shown in FIGS. 24 and 25, wherein the adjustable bulkhead is acting in a vertical direction.

In this embodiment of my invention, the structural frame member 35 is attached to suitable structural frame members of the type commonly found in railway cars and other transportation vehicles. These usually take the form of vertical "Z" or "H" channels or the like, generally indicated by the numeral 110, to which a suitable cross brace in the form of another "C" channel or the like is fastened, as indicated by the numeral 120. The structural frame member 35 of the present invention is then mounted to the cross braces 120 to provide support for mounting my invention in the railway car. Since the channels 110 are securely fastened to the bottom and sides of the car, and the cross braces 120 are fastened to the channels 110, all the forces exerted by the structural frame member are taken up by the sides and bottom of the railway car or other transportation vehicle and no upward vertical force is exerted on the roof of the railway car. Again, in actual operation, similarly to that previously described, the hydraulic cylinder 25 operates one or more clevis linkages which again are generally designated by the numeral 27, and which include a first link 28 and a second link 29.

This linkage, as before, is connected by the short link 30 to the piston rod 26 on one end, and to the movable bulkhead panel, generally designated by the numeral 31, on the other end, all of these devices being rotatably attached to the shaft 32, which is supported by the structural member 35.

A particular advantage of the vertically acting embodiment of my invention over that shown before is illustrated in FIGS. 23–25 where the same rail car may contain a combination of uniform and irregular lading. FIG. 24 shows panel 31 acting on the top surface of a regular lading, while FIG. 25 shows how the vertically acting bulkhead can adjust to irregular lading.

It is well within the scope of the invention to have several vertical acting bulkheads along the length of the rail car as shown in FIG. 20 so that both the regular and irregular ladings may be placed in the same car.

It should be understood that all embodiments of my invention can be used in all types of transportation carriers, and referring to FIG. 18, Applicant's invention is shown mounted in a semi-trailer, with the structural frame member mounted adjacent the forward end wall of the semi-trailer, with force being applied by the movable panel 31 in a direction parallel to the longitudinal axis of the semi-trailer 87.

An alternate use for this embodiment of the invention is shown in FIG. 19, where two half-panels 76 form the rear doors of the semi-trailer 87, and are adapted to swivel open about the hinges 90. To provide additional support to prevent the panels 76 from opening when forces are applied thereby by the expansion of the movable panels 31, removably mounted reinforcing members 91 can be used. In some cases, the door locks on the trailer can perform the same function as the member 91.

It should be understood that although the invention of Applicant is particularly useful in transportation vehicles such as railroad cars, semi-trailers and the like, because it is entirely self-contained, it obviously can be used for other forms of transportation, such as ships and airplanes, where its use would be beneficial. The only difference being that a constant air pressure would be supplied to the air fill conduit 46, as shown in FIG. 4, with the possible elimination of the air fill valve 41. In this instance, the on-off valve 33 would still be used to fill the air cylinder 39 to a predetermined pressure, and then the constant source would be disconnected from the system by the valve 38.

Figure 6:
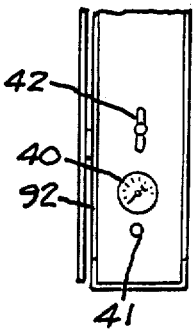
FIG. 6 is a partial cut-away view showing the external connections to the system of FIGS. 4 and 5.

Whether used as a self-contained system,, or as one connected to an on board source of air supply, a panel 92, such as that shown in FIG. 6, may be used, upon which the valve operating means 42, the pressure gauge 40, and the air control valve 41 may be mounted.

Thus, by abandoning a bulkhead system solely dependent on air pressure, and using a combination of air pressure and hydraulic pressure to operate a mechanical linkage in a manner such that a substantially uniform pressure is applied to the lading at all times, and the possibility of voids developing is entirely eliminated, Applicant has achieved all the objectives listed above, and numerous additional advantages.

I claim:

1. An adjustable bulkhead adapted for movement in the vertical direction of the type having at least one structural member mounted in a substantially horizontal plane and at least one movable bulkhead panel operatively connected thereto by means of a clevis linkage with at least one air-operated actuating means adapted to operate such clevis linkage in such a manner as to expand said panel in a vertical direction against the lading to maintain a substantially constant loading thereon regardless of the amount of expansion of said movable bulkhead panel, wherein said air operated actuating means includes at least one air operated hydraulic actuating means supplied by an air supply of a fixed predetermined initial volume, said fixed volume air supply effecting a decreased pressure being applied to said hydraulic actuating means as the mechanical advantage of said clevis linkage comes into effect, thereby maintaining said constant loading.

2. The device defined in claim 1, wherein said clevis linkage system includes at least one shaft member rotatably secured to such structural member, and at least one clevis linkage connected at one end to said shaft and at the other end to said movable bulkhead.

3. An adjustable vertically acting bulkhead including at least one structural frame member adapted to be mounted in a substantially horizontal plane to suitable reinforcing members of the type found in transportation vehicles, and at least one movable bulkhead panel with means operatively connecting said structural frame member and said movable panel, said connecting means including at least one shaft member rotatably secured to said structural member, and at least one clevis linkage connected at one end to said shaft and at the other end to said movable bulkhead, and at least one actuating means to operate said connecting means to expand said panel against a lading and maintain a substantially constant loading thereon regardless of the amount of expansion of the movable bulkhead panel, wherein said actuating means include at least one connecting link fixedly mounted to said shaft, a hydraulic cylinder connected at one end to said link, and at the other end to said frame member, and means to operate said hydraulic cylinder, wherein said hydraulic cylinder operating means include a fixed volume air reservoir with filling means attached, a conduit connected at one end to said air reservoir and communicating with the interior thereof, an air-operated hydraulic pump connected to the other end of said conduit and adapted to be operated by the air from said reservoir, an oil reservoir connected to the inlet of said pump, a check valve connected to the outlet of said pump, a four-way valve connected to said check valve, said oil reservoir and said hydraulic cylinder in such a manner that when said four-way valve is in a first appropriate position, the hydraulic cylinder will expand causing said movable panel to move into engagement with a lading, after which said pump will stall, and when in a second appropriate position will cause the hydraulic cylinder to contract and move away from said lading.

4. The device defined in claim 3, wherein an on-off valve is interposed in the conduit between said reservoir and said conduit.

5. The device defined in claim 3, wherein the volume of the fixed air reservoir is of a predetermined value such that as said clevis linkage expands and its inherent mechanical advantage comes into play, the air supply to said air-operated hydraulic pump will decrease in pressure to a degree to keep the force exerted on said load by said movable panel substantially constant throughout the expansion of the bulkhead.

6. An adjustable vertically acting bulkhead including at least one structural frame member adapted to be mounted in a substantially horizontal plane to suitable reinforcing members of the type found in transportation vehicles, and at least one movable bulkhead panel with means operatively connecting said structural frame member and said movable panel, said connecting means including at least one shaft member rotatably secured to said structural member, and at least one clevis linkage connected at one end to said shaft and at the other end to said movable bulkhead, and at least one actuating means to operate said connecting means to expand said panel against a lading and maintain a substantially constant loading thereon regardless of the amount of expansion of the movable bulkhead panel, wherein said actuating means include at least one connecting link fixedly mounted to said shaft, a hydraulic cylinder connected at one end to said link, and at the other end to said frame member, and means to operate said hydraulic cylinder, wherein said hydraulic cylinder operating means include a fixed volume air reservoir with filling means attached, a conduit connected at one end to said reservoir and communicating with the interior thereof, an air-operated hydraulic pump connected to the other end of said conduit and adapted to be operated by the air from said reservoir, an oil reservoir connected to the inlet of said pump, a check valve connected to the outlet of said pump, a spring return means interposed between said hydraulic cylinder and said link, and a two-way oil bleed valve connected to said check valve and said hydraulic cylinder in such a manner that when said bleed valve is closed, said hydraulic cylinder will expand causing said movable panel to expand and move into engagement with said lading, after which said pump will stall, and when said valve is open, to cause the spring return means to force the oil from said cylinder into said reservoir, causing said movable panel to retract.

7. The device defined in claim 6, wherein an on-off valve is interposed in the conduit between said reservoir and said conduit.

8. The device defined in claim 7, wherein said movable bulkhead is constructed of steel with suitable support framing.

9. The device defined in claim 7, wherein said movable bulkhead panel is constructed of plywood with suitable support framing.

10. The device defined in claim 6, wherein the volume of the fixed air reservoir is of a predetermined value such that as said clevis linkage expands and its inherent mechanical advantage comes into play, the air supply to said air-operated hydraulic pump will decrease in pressure to a degree to keep the force exerted on said load by said movable panel substantially constant throughout the expansion of the bulkhead.

11. An adjustable vertically acting bulkhead, including at least one structural frame member adapted to be mounted in a substantially horizontal plane and fastened by suitable fastening means to side wall reinforcements of the type commonly found in a transportation vehicle, and at least one movable bulkhead panel, with means operatively connecting said structural frame member and said movable panel, said connecting means including an upper and a lower shaft rotatably mounted to said structural member in a spaced relationship parallel to the plane thereof, two upper clevis linkages being symmetrically but fixedly connected at one end to said upper shaft, two lower clevis linkages being symmetrically but fixedly mounted to said lower shaft at one end thereof, the other ends of said upper and said lower clevis linkages being mounted to said movable panel, and at least one actuating means to operate said connecting means to expand said panel against a lading and maintain a substantially constant loading thereon regardless of the amount of expansion of the movable bulkhead panel, wherein said actuating means include a lower connecting link fixedly mounted to said lower shaft between said lower clevis linkages, an upper connecting link fixedly mounted to said upper shaft between said upper clevis linkages, a connecting bar rotatably mounted to said upper connecting link and a hydraulic cylinder connected at one end to said connecting bar, and at the other end to said lower link, and means to operate said hydraulic cylinder, wherein said hydraulic cylinder operating means include a fixed volume air reservoir, a conduit connected at one end to said reservoir and communicating with the interior thereof, an air-operated hydraulic pump connected to the other end of said conduit and adapted to be operated by the air in said reservoir, an oil reservoir connected to the inlet of said pump, a check valve connected to the outlet of said pump, and a four-way valve connected to said check valve, said oil reservoir, and said hydraulic cylinder in such a manner that when said four-way valve is in a first appropriate position, the hydraulic cylinder will expand causing said movable panel to move into an engagement with said lading, at which time said pump will stall and pressure in the cylinder will be maintained by said check valve until the load shifts, allowing the pump to again operate, and when in said second appropriate position will cause said hydraulic cylinder to contract and move away from said lading.

12. The device defined in claim 11, wherein the volume of the fixed air reservoir is of a predetermined value such that as said clevis linkages expand and their inherent mechanical advantage comes into play, the air supplied to said air-operated hydraulic pump by said reservoir will decrease in pressure to a degree sufficient to keep the force exerted on said load by said movable bulkhead panel substantially constant throughout the expansion of said bulkhead.

13. The device defined in claim 12, wherein the movable bulkhead panel is made out of plywood.

14. The device defined in claim 12, wherein the movable bulkhead panel is made out of metal with suitable support framing.

15. An adjustable vertically acting bulkhead, including at least one structural frame member adapted to be mounted in a substantially horizontal plane and fastened by suitable fastening means to side wall reinforcements of the type commonly found in a transportation vehicle, and at least one movable bulkhead panel, with means operatively connecting said structural and said movable panel, said connecting means including an upper and a lower shaft rotatably mounted to said structural member in a spaced relationship parallel to the plane thereof, two upper clevis linkages being symmetrically but fixedly connected at one end to said upper shaft, two lower clevis linkages being symmetrically but fixedly mounted to said lower shaft at one end thereof, with the other ends of said upper and said lower clevis linkages being mounted to said movable panel, and at least one actuating means to operate said connecting means to expand said panel against a lading and maintain a substantially constant loading thereon regardless of the amount of expansion of the movable bulkhead panel, wherein said actuating means include a lower connecting link fixedly mounted to said lower shaft between said lower clevis linkages, an upper connecting link fixedly mounted to said upper shaft between said upper clevis linkages, a connecting bar rotatably mounted to said upper connecting link and a hydraulic cylinder connected at one end to said connecting bar, and at the other end to said lower link, and means to operate said hydraulic cylinder, wherein said hydraulic cylinder operating means include a fixed volume air reservoir, a conduit connected at one end to said reservoir and communicating with the interior thereof, an air-operated hydraulic pump connected to the other end of said conduit and adapted to be operated by the air from said reservoir, an oil reservoir connected to the inlet of said pump, a check valve connected to the outlet of said pump, spring return means operating in opposition to said hydraulic cylinder interposed between said hydraulic cylinder and said connecting bar, and a two-way bleed valve connected to said check valve and said hydraulic cylinder in such a manner that when said valve is closed, said hydraulic cylinder will expand, causing said movable panel to expand and move into engagement with said lading, after which time said pump will stall and the pressure in the cylinder will be maintained by said check valve, and when said valve is open, to cause said spring return means to force said oil from said cylinder back into said reservoir causing said movable panel to retract.

16. The device defined in claim 15, wherein an on-off valve is interposed between said reservoir and said conduit.

17. The device defined in claim 15, wherein an on-off valve is interposed between said reservoir and said conduit.

18. The device defined in claim 15, wherein the volume of the fixed air reservoir is of a predetermined value such that as said clevis linkages expand and their inherent mechanical advantage comes into play, the air supplied to said air-operated hydraulic pump by said reservoir will decrease in pressure to a degree sufficient to keep the force exerted on said load by said movable bulkhead panel substantially constant throughout the expansion of said bulkhead.

19. The device defined in claim 18, wherein said air-operated hydraulic pump has an one to eight multiplication ratio.

20. A transportation vehicle having top and side walls and a floor, with suitable side wall reinforcements in the form of vertically extending channels, together with cross braces mounted between said vertically extending channels, and including an adjustable bulkhead adapted to be mounted in such vehicle in a substantially horizontal plane by being fastened by suitable means to said cross braces, and including an adjustable bulkhead mounted in said vehicle of the type having at least one structural frame member, and at least one movable bulkhead panel operatively connected thereto by a clevis linkage system and including at least one stallable air-operated hydraulic actuating means supplied by an air supply of a predetermined fixed volume and adapted to operate such clevis linkage system in such a manner as to expand said panel until said actuating means stalls whenever said means is activated initially upon the placing of lading in a vehicle, and subsequently upon the shifting of lading until said hydraulic actuating means stalls, said fixed volume air supply effecting a decreased pressure being supplied to said hydraulic actuating means as the mechanical advantage of said clevis linkage system comes into effect, thereby maintaining a substantially constant loading upon said lading regardless of the amount of expansion of said movable bulkhead panel, with said pressure being controlled by said air supply of predetermined fixed volume.

21. The device claimed in claim 20 being mounted in a semi-trailer near the top thereof.

22. The device defined in claim 20, wherein said air-operated hydraulic actuating means includes at least one connecting link fixedly mounted to said shaft, a hydraulic cylinder connected at one end to said link and at the other end to said frame member, and means to operate said hydraulic cylinder.

* * * * *